US007746298B2

(12) United States Patent
Shin

(10) Patent No.: US 7,746,298 B2
(45) Date of Patent: Jun. 29, 2010

(54) ORGANIC LIGHT EMITTING DISPLAY AND DRIVING METHOD THEREOF

(75) Inventor: Dong-Yong Shin, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1462 days.

(21) Appl. No.: 11/113,444

(22) Filed: Apr. 22, 2005

(65) Prior Publication Data

US 2005/0253791 A1 Nov. 17, 2005

(30) Foreign Application Priority Data

May 11, 2004 (KR) ..... 10-2004-0032962

(51) Int. Cl.
*G09G 3/30* (2006.01)

(52) U.S. Cl. ..... 345/76; 345/82; 315/169.3

(58) Field of Classification Search ..... 345/76, 345/82, 100, 204; 315/169.3; 327/333; 313/505; 257/88

See application file for complete search history.

(56) References Cited

U.S. PATENT DOCUMENTS

| | | | | |
|---|---|---|---|---|
| 4,996,523 | A | 2/1991 | Bell et al. | |
| 6,288,496 | B1 | 9/2001 | Suzuki et al. | |
| 6,753,834 | B2 * | 6/2004 | Mikami et al. | 345/76 |
| 6,937,222 | B2 * | 8/2005 | Numao | 345/98 |
| 2003/0178947 | A1 | 9/2003 | Shin et al. | |

FOREIGN PATENT DOCUMENTS

| | | | |
|---|---|---|---|
| CN | 1447305 | A | 10/2003 |
| EP | 1 274 065 | A2 | 1/2003 |
| JP | 5-119741 | A | 5/1993 |
| JP | 6-208340 | A | 7/1994 |
| JP | 2001-324958 | A | 11/2001 |
| JP | 2002-268615 | A | 9/2002 |
| JP | 2003-76331 | A | 3/2003 |
| JP | 2003-157064 | A | 5/2003 |
| JP | 2003-173154 | A | 6/2003 |
| JP | 2003-216100 | A | 7/2003 |
| JP | 2003-223138 | A | 8/2003 |
| JP | 2003-255899 | A | 9/2003 |
| JP | 2004-94058 | A | 3/2004 |
| JP | 2004-318093 | A | 11/2004 |
| WO | WO 98/36407 | A1 | 8/1998 |
| WO | WO 03/027998 | A1 | 4/2003 |

* cited by examiner

*Primary Examiner*—Abbas I Abdulselam
(74) *Attorney, Agent, or Firm*—Christie, Parker & Hale, LLP

(57) ABSTRACT

A light emission device according to the present invention includes a plurality of pixel circuits in a matrix. A plurality of first scan lines transmits a selection signal to select the pixel circuits. A plurality of second scan lines transmits an emission signal to control the duration of light emission of the pixel circuits. A scan driver sequentially delays a primary signal having a first-level pulse about a first period for generating a plurality of secondary signals, inverting the plurality of secondary signals for outputting the emission signal, and generating a signal having a second-level pulse when the secondary signal and the emission signal are in the first-level.

26 Claims, 16 Drawing Sheets

ORGANIC LIGHT EMITTING DISPLAY AND DRIVING METHOD THEREOF

CROSS REFERENCE TO RELATED APPLICATION

This application claims priority to and the benefit of Korean Patent Application No. 10-2004-0032962 filed on May 11, 2004 in the Korean Intellectual Property Office, the entire content of which is incorporated herein by reference.

BACKGROUND OF THE INVENTION

1. Field of the Invention

The present invention relates to an organic light emitting display and a driving method thereof, and more particularly, it relates to an organic light emitting diode (hereinafter, 'OLED') display and a driving method thereof.

2. Description of the Related Art

In general, an OLED display electrically excites phosphorus organic components, and visualizes an image by voltage-programming or current-programming M, X, and N numbers of organic light emitting cells. These organic light emitting cells include anode indium tin oxide (ITO), organic thin film, and cathode (metal) layers. The organic thin film layer has a multi-layered structure including an emission layer, an electro transport layer (ETL), and a hole transport layer (HTL) so as to balance electrons and holes and thereby enhancing efficiency of light emission. Further, the organic thin film separately includes an electron injection layer (EIL) and a hole injection layer (HIL).

A method of driving the organic light emitting cells having the foregoing configuration includes a passive matrix method and an active matrix method, the active matrix method employing a thin film transistor (TFT). In the passive matrix method, an anode and a cathode are formed crossing each other, and a line is selected to drive the organic light emitting cells. However, in the active matrix method, each indium tin oxide (ITO) pixel electrode is coupled to the TFT and the light emitting cell is driven in accordance with a voltage maintained by the capacitance of a capacitor coupled to a gate of the TFT. Herein, the active matrix method is classified as a voltage programming method or a current programming method depending on the type of signals transmitted to the capacitor so as to distinctively control the voltage applied to the capacitor.

FIG. 1 is an equivalent circuit diagram of a pixel circuit according to a conventional voltage-programming method. A conventional OLED display device employing the voltage-programming method supplies current to an is OLED display through a transistor M1A coupled thereto for light emission. The amount of current supplied to the OLED is adjusted by a data voltage applied through a switching transistor M2A. Herein, a capacitor C1A is coupled between a source and a gate of the transistor M1A to maintain the amount of the data voltage applied for a predetermined time period.

When the transistor M2A is turned on, the data voltage is applied to the gate of the transistor M1A, and a voltage of $V_{GS}$ between the gate and the source is charged to the capacitor C1A. A current $I_{OLED}$ flows corresponding to the voltage of $V_{GS}$, and the OLED emits light corresponding to the current $I_{OLED}$.

Herein, the current flowing to the OLED is given as Equation 1.

$$I_{OLED} = \frac{\beta}{2}(V_{GS} - V_{TH})^2 = \frac{\beta}{2}(V_{DD} - V_{DATA} - |V_{TH}|)^2 \quad \text{[Equation 1]}$$

where $I_{OLED}$ represents a current flowing to the OLED, $V_{GS}$ represents a voltage between the gate and source of the transistor M1A, $V_{TH}$ represents a threshold voltage of the transistor M1A, $V_{DATA}$ represents a data voltage, and β represents a constant number.

As shown in Equation 1, the current corresponding to the data voltage is supplied to the OLED, and the OLED emits light corresponding to the current supplied thereto. Herein, the data voltage has multi-leveled values within a predetermined range to express gray scales.

However, a pixel circuit according to a conventional voltage-programming method has a problem of expressing high-level gray scales due to deviation of the threshold voltage $V_{TH}$ of the TFT and mobility of a carrier, the deviation being generated as a result of a non-uniform manufacturing process of a TFT. For instance, when the pixel circuit drives a TFT of a pixel using 3V to express 8-bit gray scales (256 gray scales), a gate of the TFT must be applied with a voltage at an interval of less than 12 mV (=3V/256). However, it is difficult to express a high gray scale in the case that the deviation of the threshold voltage VTH is 100 mV due to the non-uniform manufacturing process. Moreover, the deviation of mobility causes the value of β to be changed in Equation 1, and thus expressing the high level gray scale becomes more difficult.

On the other hand, although the amount of current and voltage supplied from a driving transistor in each of pixels is not uniform, the circuit of pixels employing the current-programming method can provide panel uniformity as long as current supplied from a current source to the pixel circuit is uniform.

FIG. 2 shows an equivalent circuit diagram of a pixel circuit according to a conventional current-programming method. A transistor M1B is coupled to an OLED to supply a current for light emission, and the amount of the current is adjusted by a data current applied through a transistor M2B.

Accordingly, when transistors M2B and M3B are turned on, a voltage corresponding to the data current $I_{DATA}$ is stored in a capacitor C1B. The amount of current corresponding to the stored voltage flows to the OLED so that the OLED emits light. Herein, the current flowing to the OLED is given as Equation 2.

$$I_{OLED} = \frac{\beta}{2}(V_{GS} - |V_{TH}|)^2 = I_{DATA} \quad \text{[Equation 2]}$$

where $V_{GS}$ represents a voltage between a gate and a source of a transistor M1B, $V_{TH}$ represents a threshold voltage of the transistor M1B, and β represents a constant number.

As shown in Equation 2, the current flowing throughout a panel can be uniform since the amount of the current $I_{OLED}$ flowing to the OLED is the same as the amount of the data current $I_{DATA}$ according to the conventional current-programming method. However, a little current ($I_{DATA}$) flows to the OLED, and thus it takes too much time to charge data lines. For instance, assume that the load of capacitor in the data line is set to be 30 pF. In this case, it takes several milliseconds to charge the load of the capacitance with data currents of several tens of nA to several hundreds of nA. However, line time is inefficient for full charging of the data line since it is limited to several μs.

Moreover, increasing the amount of the current $I_{OLED}$ flowing to the OLED so as to reduce time consumed for charging the data line may cause the brightness of all pixels to increase, thereby resulting in a decrease of image quality.

SUMMARY OF THE INVENTION

In accordance with the present invention, a method of charging data lines of a light emission apparatus readily and promptly is provided, thereby preventing a decrease of image quality.

In one aspect of the present invention, an organic light emitting display device includes a plurality of pixel circuits in a matrix. A plurality of first scan lines transmits selection signals to select the pixel circuits. A plurality of second scan lines transmits an emission signal to control duration of light emission of the pixel circuits. A scan driver sequentially delays a primary signal having a first-level pulse by a first period for generating a plurality of secondary signals, inverting the plurality of secondary signals and outputting them as emission signals. A signal having a second-level pulse is generated when the secondary signals and the emission signals are in the first level.

The scan driver includes a shift register sequentially delaying the primary signal by the first period and generating a plurality of secondary signals.

The scan driver inverts a second secondary signal to output the inverted signal as an emission signal, and generates a signal having a second-level pulse when a first signal of the secondary signals and the emission signal are both in the first level so as to output the signal as the selection signal.

The shift register includes a plurality of flip-flops generating the input signal as the secondary signal by delaying an input signal by the first period.

The flip-flops include a first inverter synchronized to a first clock signal and inverting the input signal so as to output the inverted signal, a second inverter inverting the output signal of the first inverter so as to output the inverted output signal as the secondary signal, and a third inverter coupled to the second inverter so as to synchronize the secondary signal to a second clock signal, invert the secondary signal, and output the inverted signal.

The first clock signal and the second clock signal are inverted with respect to each other.

Among the plurality of flip-flops, the first clock signal applied to odd numbered flip-flops and the first clock signal applied to even numbered flip-flops are inverted with respect to each other.

The scan driver outputs an input signal of the second inverter included in the second flip-flop among adjacent flip-flops as the emission signal.

The scan driver outputs a signal as the selection signal, and the signal having the second-level pulse when an output signal of the first flip-flop among the adjacent flip-flops and the emission signal are in the first level.

The first period is substantially the same as a half period of the first clock signal.

In another aspect of the present invention, an organic light emitting device includes a plurality of pixel circuits in a matrix. A plurality of first scan lines transmit a selection signal to select the pixel circuits. A plurality of second scan lines transmit an emission signal to control duration of light emission of the pixel circuits. A first driver sequentially delays a primary signal having a first level pulse by a first period in response to a clock signal so as to output a secondary signal. A second driver inputs a plurality of secondary signals and third signals which are inverted signals of the secondary signals, and outputs selection signals having a second level pulse when the secondary signals and the third signals are in the first level. A third driver inputs the plurality of secondary signals and a fourth signal and outputs a signal as the emission signal, the signal having the second level pulse when the secondary signals and the fourth signal are in the first level.

The fourth signal has the second level pulse when the level of the clock signal is changed.

The first period is substantially the same as a half period of the clock signal.

In another embodiment of the present invention, an organic light emitting device includes a plurality of pixel circuits in a matrix. A plurality of first scan lines transmits a selection signal to select the pixel circuits. A plurality of second scan lines transmits an emission signal to control duration of light emission of the pixel circuits. A first driver sequentially delays a primary signal having a first level pulse about a first period in response to a first clock signal so as to output a plurality of secondary signals. A second driver generates a fourth signal having a second-level pulse when a third signal, which is an inverted signal of first and second secondary signals among adjacent secondary signals, is in the first-level, and outputs the emission signal that is an inverted signal of the second secondary signal. A third driver inputs the fourth signal, and changes the lateral ends of the second level pulse of the fourth signal into the first level during a predetermined period so as to output the fourth signal as the selection signal.

The first driver includes a plurality of flip-flops having a first inverter synchronized to a second clock signal and inverting the input signal so as to output the inverted signal. A second inverter inverts the output signal of the first inverter so as to output the inverted output signal as the secondary signal. A third inverter is coupled to the second inverter and synchronizes the secondary signal to a third clock signal so as to invert the secondary signal and output the inverted signal.

The second clock signal is applied to odd numbered flip-flops among the plurality of flip-flops and is substantially the same as the first clock signal, and the third clock signal is an inverted signal of the first clock signal.

The second clock signal applied to even numbered flip-flops among the plurality of flip-flops is an inverted signal of the first clock signal, and the third clock signal is substantially the same as the first clock signal.

The third signal is an input signal of the second inverter included in the flip-flip outputting the secondary signal.

The third driver further inputs a fifth signal alternately having the first level and the second level, and outputs the selection signal having the second-level pulse when the fourth signal is in the second level and the fifth signal is in the first level.

The fifth signal has the second level pulse when the level of the first signal is changed.

In another embodiment of the present invention, a method of driving an organic light emitting device having a plurality of first scan lines transmitting a selection signal and a plurality of second scan lines transmitting an emission signal includes: sequentially delaying a primary signal having a first level pulse by a first period so as to generate a plurality of secondary signals; inverting the secondary signals so as to output the emission signal; and outputting the selection signal having a second level pulse when the secondary signals and the emission signal are in the first level.

The width of the selection signal is substantially the same as the first period.

In another embodiment of the present invention, a method of driving an organic light emitting device having a plurality of first scan lines transmitting a selection signal and a plurality of second scan lines transmitting an emission signal includes: synchronizing the primary signal having a first-level signal to a clock signal and sequentially delaying the synchronized signal by a first period so as to generate a plurality of secondary signals; inverting the secondary signals so as to generate a third signal having a second-level pulse; changing the lateral ends of the second level pulse of the third signal into the first level during a predetermined period so as to output the emission signal; and outputting the selection signal having the second-level pulse when the secondary signal and the emission signal are in the first level.

In another embodiment of the present invention, a method of driving an organic light emitting device having a plurality of first scan lines transmitting a selection signal and a plurality of second scan lines transmitting an emission signal includes: sequentially delaying a primary signal having a first level pulse by a first period so as to generate a plurality of secondary signals; inverting the secondary signals so as to output the emission signal; outputting a third signal having a second-level pulse when the primary signal and the emission signal are in the first-level; and changing the lateral ends of the second level pulse of the third signal into the first level during a predetermined period so as to output the selection signal.

DETAILED DESCRIPTION

Figure 1:
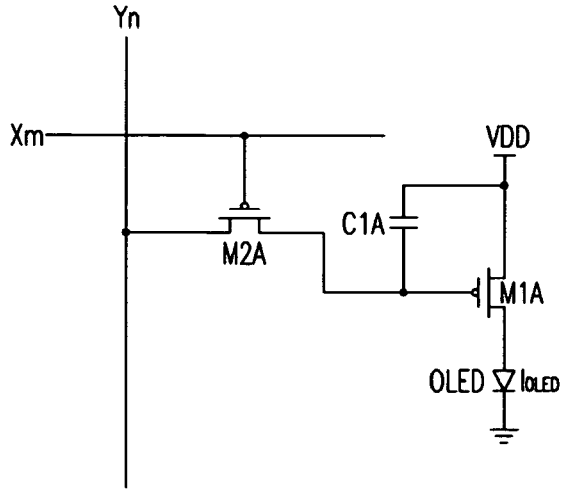
FIG.1(Prior Art)
FIG. 1 is an equivalent circuit diagram of a pixel circuit in a conventional voltage-programming method.
Figure 2:
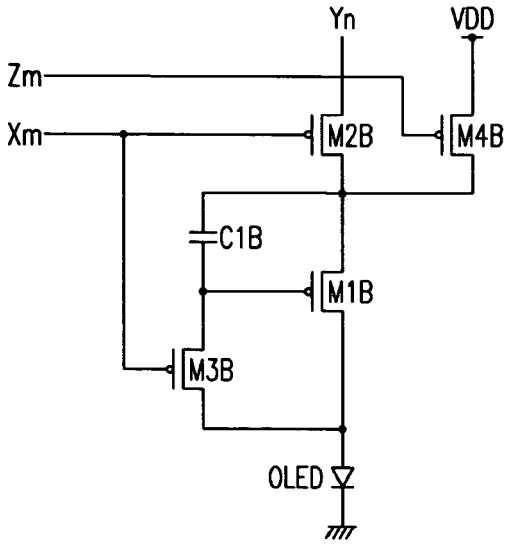
FIG.2(Prior Art)
FIG. 2 is an equivalent circuit diagram of a pixel circuit in a conventional current-programming method.
Figure 3:
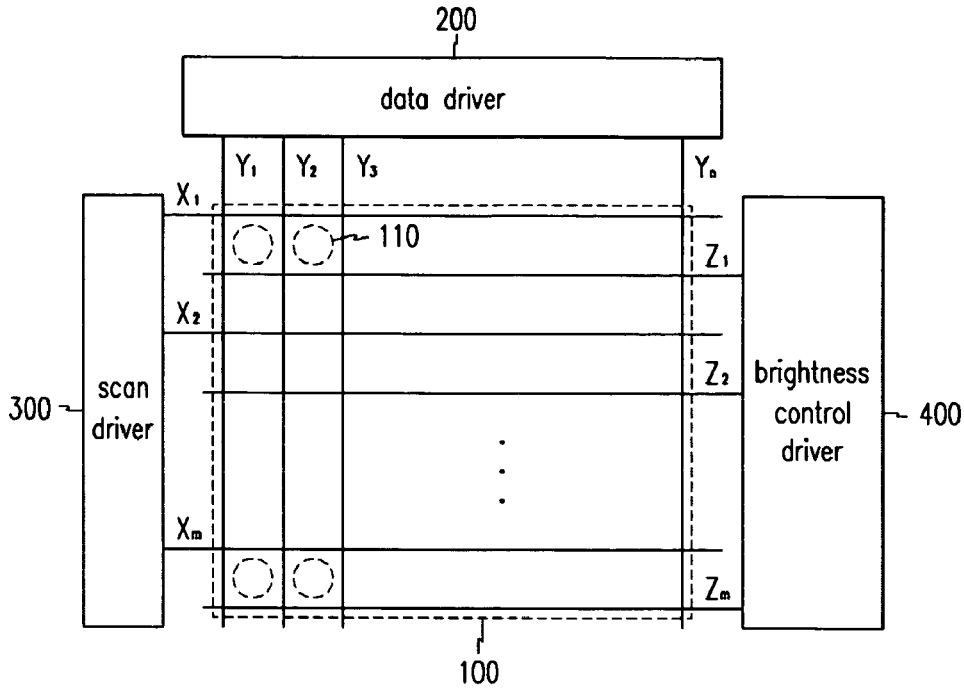
FIG. 3 is a schematic plane view of an organic light emitting display according to a first embodiment of the present invention.

Referring now to FIG. 3, the organic light emitting device according to the embodiment of the present invention includes an OLED display panel (hereinafter referred to as "display panel") 100, a data driver 200, a scan driver 300, and a brightness control driver 400.

The display panel 100 includes data lines $Y_1$ to $Y_n$ arranged in columns, scan lines $X_1$ to $X_m$ and $Z_1$ to $Z_m$ arranged in rows, and pixel circuits 110 arranged in a matrix format.

The scan lines include selection scan lines $X_1$ to $X_m$ transmitting selection signals to select pixels, and emission scan lines $Z_1$ to $Z_m$ transmitting emission signals to control the duration of light emission of the OLED. Further, a pixel circuit 110 is formed in a pixel area defined by the data lines $Y_1$ to $Y_n$, the selection scan lines $X_1$ to $X_m$, and the emission scan lines $Z_1$ to $Z_m$.

The data driver 200 applies the data current $I_{DATA}$ to the data lines $Y_1$ to $Y_n$, and the scan driver 300 sequentially applies the selection signal to the selection scan lines $X_1$ to $X_m$ to select a pixel circuit. The brightness control driver 400 sequentially applies an emission signal to the emission scan lines $Z_1$ to $Z_m$ so as to control brightness of the pixel circuit 100.

The scan driver 300 and the brightness control driver 400, and/or the data driver 200 may be electrically coupled to the display panel 100 in various schemes. Firstly, they may be formed on, e.g., a printed circuit board (PCB), and such a PCB may be connected to the display panel 100. Alternatively, they may be formed as a chip, or the like, so as to be installed to a tape carrier package (TCP), a flexible printed circuit (FPC), a film, or other connection materials connected to the display panel 100. For another example, they may be formed on a glass substrate of the display panel. In this case, they may be mounted directly on the glass substrate, or they may be formed on the same layer of the glass substrate on which the scan lines, the data lines, and the TFTs are formed.

Hereinafter, a pixel circuit 110 of an organic light emitting display according to a first embodiment of the present invention with reference to FIG. 4, FIG. 5A, and FIG. 5B will be explained.

Figure 4:
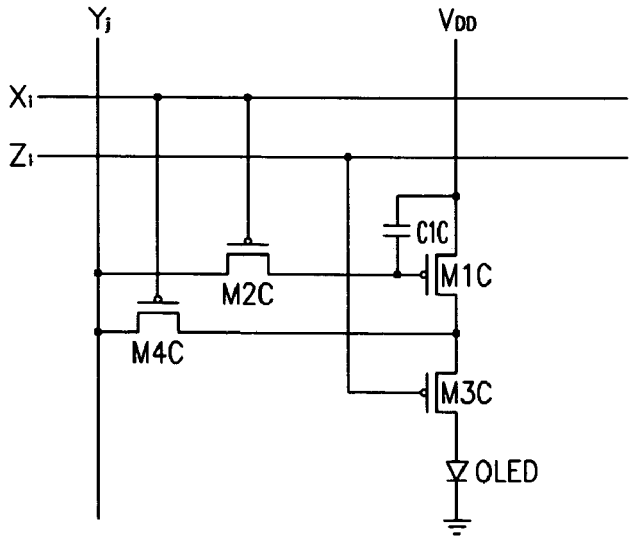
FIG. 4 is a schematic circuit diagram of a pixel circuit in the organic light emitting display according to the first embodiment of the present invention.
Figure 5A:
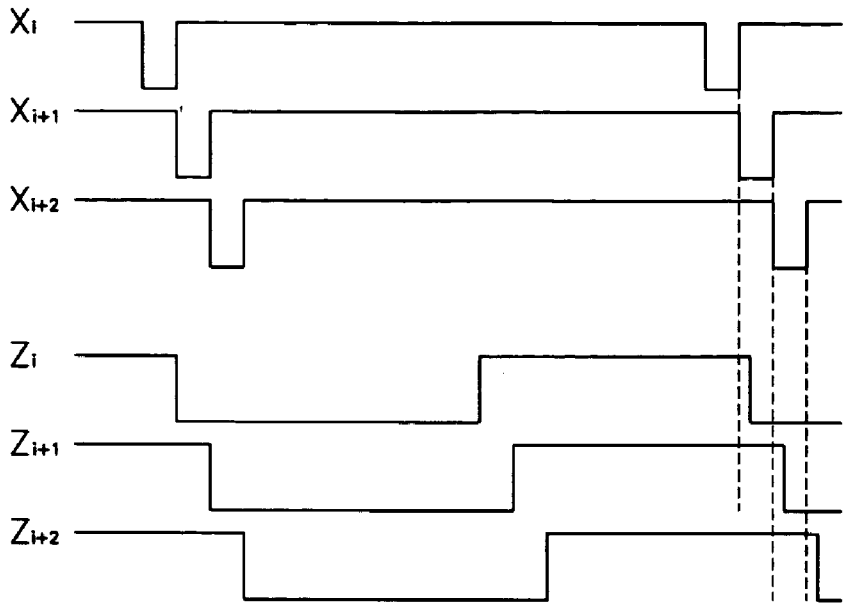
FIG. 5A shows timing of a selection signal and an emission signal respectively applied to a selection scan line and an emission scan line according to the first embodiment of the present invention.
Figure 5B:
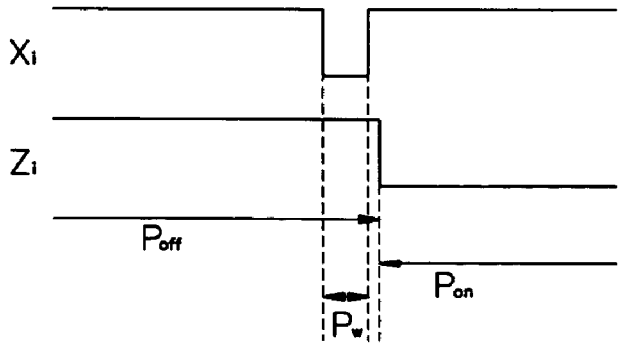
FIG. 5B compares timing of the selection signal and the emission signal.

FIG. 4 shows a pixel circuit according to the first embodiment of the present invention, and FIG. 5A and FIG. 5B show timing of the selection signal and the emission signal according to the first embodiment of the present invention. FIG. 4 illustrates a pixel circuit coupled to the jth data line $Y_j$ and the ith scan lines $X_i$ and $Z_i$, for ease of description.

As shown in FIG. 4, the pixel circuit 110 according to the first embodiment of the present invention includes an organic light emitting display (OLED), transistors M1C, M2C, M3C, M4C, and a capacitor C1C. Herein, the transistors M1C to M4C include a PMOS transistor according to the embodiment of the present invention, but are not restricted thereto. These transistors have first electrodes, second electrodes, and third electrodes formed on a glass substrate, and may be implemented by an active device outputting a current to the third electrodes corresponding to a voltage applied to the first and second electrodes.

The transistor M1C is coupled between a power source VDD and an OLED, and adjusts a current flowing to the OLED. In particular, a source of the transistor M1C is coupled to the power source VDD, and a drain of the transistor M1C is coupled to an anode of the OLED through the transistor M3C.

The transistor M2C transmits a data signal from the data line $Y_i$ to a gate of the transistor M1C in response to a selection signal transmitted from the selection scan line $X_i$. In more detail, the emission signal is maintained at a high level so as to cut off a current flowing to the transistor M3C when the data signal is programmed to the pixel circuit, whereas the emission signal is maintained at a low level so as to allow a current from the transistor M1C to flow to the OLED during a light emission period.

The transistor M4C is diode-connected to the transistor M1C in response to the selection signal.

The capacitor C1C is coupled between the gate and the source of the transistor M1C, and charges a voltage corresponding to the data current $I_{DATA}$ from the data line $Y_i$.

The transistor M3C responds the emission signal from the emission scan line $Z_i$ by transmitting the current flowing to the transistor M1C to the OLED.

Hereinafter, an operation of the pixel circuit shown in FIG. 4 will be described with reference to FIG. 5A and FIG. 5B.

FIG. 5A shows timing of a selection signal and an emission signal respectively applied to the selection scan line and the emission scan line according to the first embodiment of the present invention, and FIG. 5B compares the timing between the selection signal and the emission signal.

As shown in FIG. 5A, the selection signal is sequentially applied to the selection scan lines $X_i$, $X_{i+1}$, and $X_{i+2}$ to turn on the transistor M2C. Thus, when the transistor M2C is turned on, a voltage corresponding to the amount of the data current $I_{DATA}$ from the data lines $Y_1$ to $Y_n$ is charged to the capacitor C1C. Herein, the transistor M4C is also turned on by the selection signal, and the transistor M1C is diode-connected. Accordingly, the capacitor C1C is charged with the voltage corresponding to the amount of the data current $I_{DATA}$ flowing through the transistor M1C. In this case, the transistor M3C is in a state of being turned off. When the capacitor C1C has been fully charged, the transistors M2C and M4C are turned off and the transistor M3C is turned on by the emission signal transmitted from the emission scan lines $Z_i$, $Z_{i+1}$, and $Z_{i+2}$, and thus the data current $I_{DATA}$ flows through the transistor M3C.

During the operation of the organic light emitting display, a level of the emission signal transmitted to the emission scan lines $Z_i$, $Z_{i+1}$, and $Z_{i+2}$ is sequentially changed. In the case that a low-level emission signal is transmitted to the emission scan lines $Z_i$, $Z_{i+1}$, and $Z_{i+2}$, the transistor M3C is turned on and thus the current from the transistor M1C is supplied to the OLED and accordingly the OLED emits light [light-on period $P_{on}$]. However, when a high-level emission signal is transmitted to the emission scan lines $Z_i$, $Z_{i+1}$, and $Z_{i+2}$, the transistor M3C is turned off and thus the current from the transistor M1C cannot be supplied to the OLED. Accordingly, the OLED does not emit light [light-off period $P_{off}$].

In more detail, the selection signal is transmitted to the selection scan line $X_i$ to turn on the transistor M1C during the light-off period as shown in FIG. 5B, and the voltage corresponding to the data current $I_{DATA}$ from the data lines $Y_1$ to $Y_n$ is charged to the capacitor C1C [writing period $P_w$]. There is a short time between the writing period and the light-on period $P_{on}$, and the light-on period $P_{on}$ starts when the emission signal transmitted to the emission scan line $Z_i$ becomes a low-level signal. When the emission signal becomes a high-level signal after the light emission is sustained for a predetermined time period, the current cannot be supplied to the OLED and accordingly the light-off period $P_{off}$ is started.

In a like manner of the foregoing embodiment of the present invention, a duty ratio of the emission signal transmitted from the brightness control driver 400 determines the length of the light-on period and the light-off period respectively, and the length of these periods affects brightness. Further, application of high-level data current does not cause the brightness of all pixels to be increased, and thereby less power is consumed when the brightness control driver is driven in a duty driving mode. In addition, characteristic deviations between currents of these transistors become small by using a high-current area, thereby driving the organic light emitting display stably.

Hereinafter, a driver generating a driving waveform according to an embodiment of the present invention will be described in more detail with reference to FIG. 5A. Compared to FIG. 3 illustrating that the brightness control driver 400 generating the emission signal and the scan driver 300 generating the selection signal are separately provided, and the following embodiment mainly describes a scan driver generating a selection signal and an emission signal.

Figure 6:
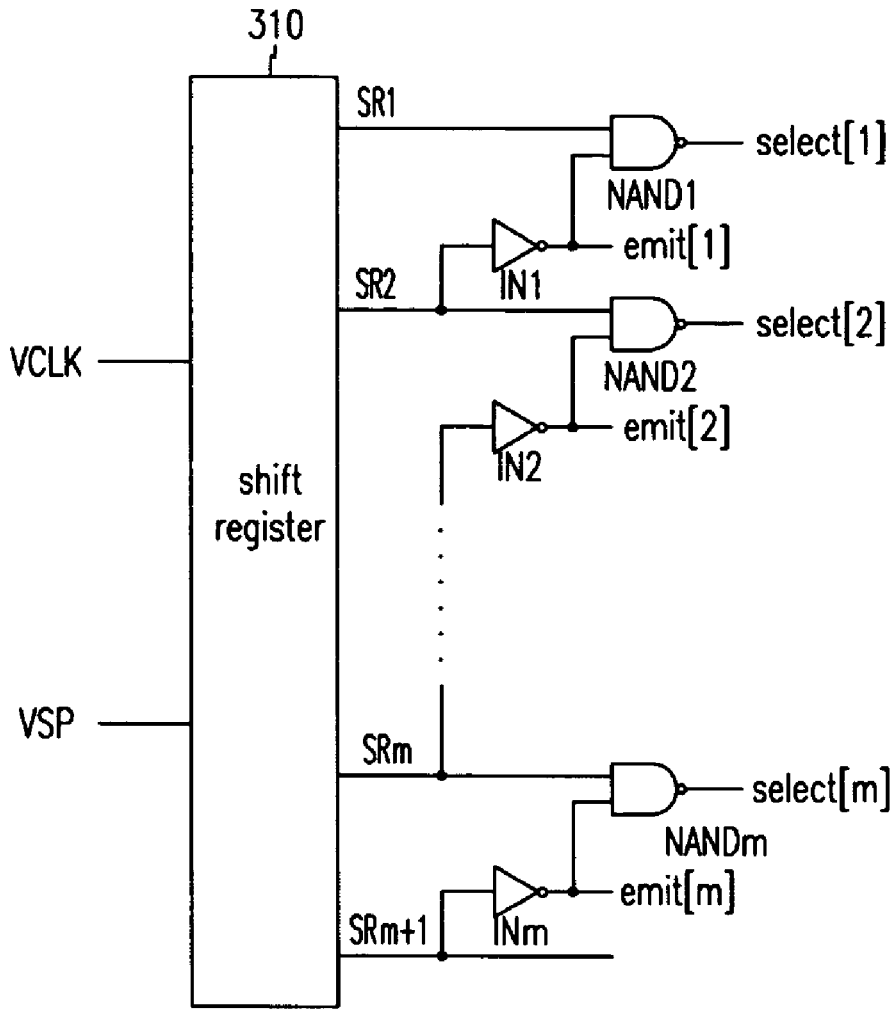
FIG. 6 is a circuit diagram of a scan driver according to the first embodiment of the present invention.
Figure 7:
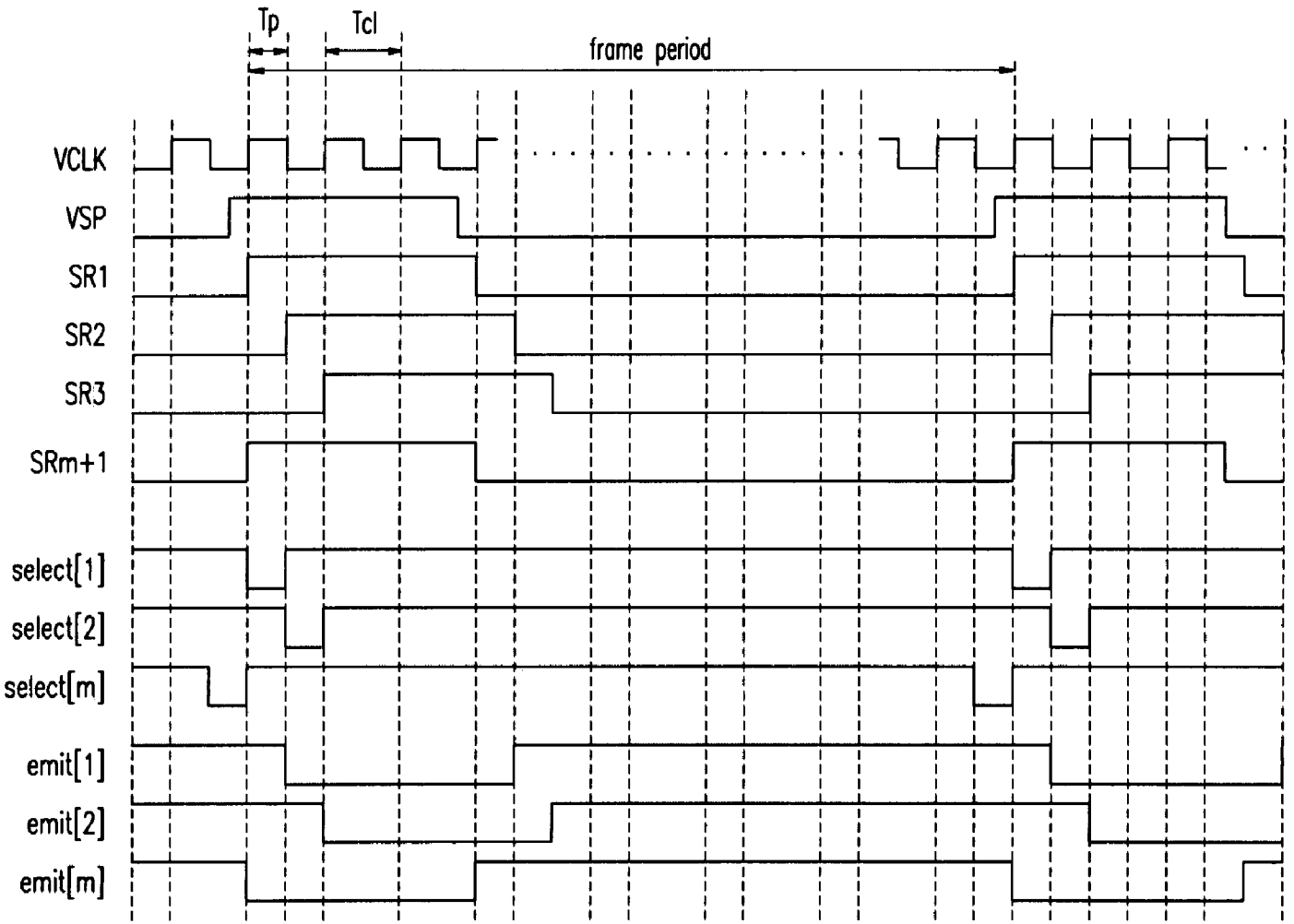
FIG. 7 and FIG. 8 are driving waveforms of the scan driver according to the first embodiment of the present invention.
Figure 8:
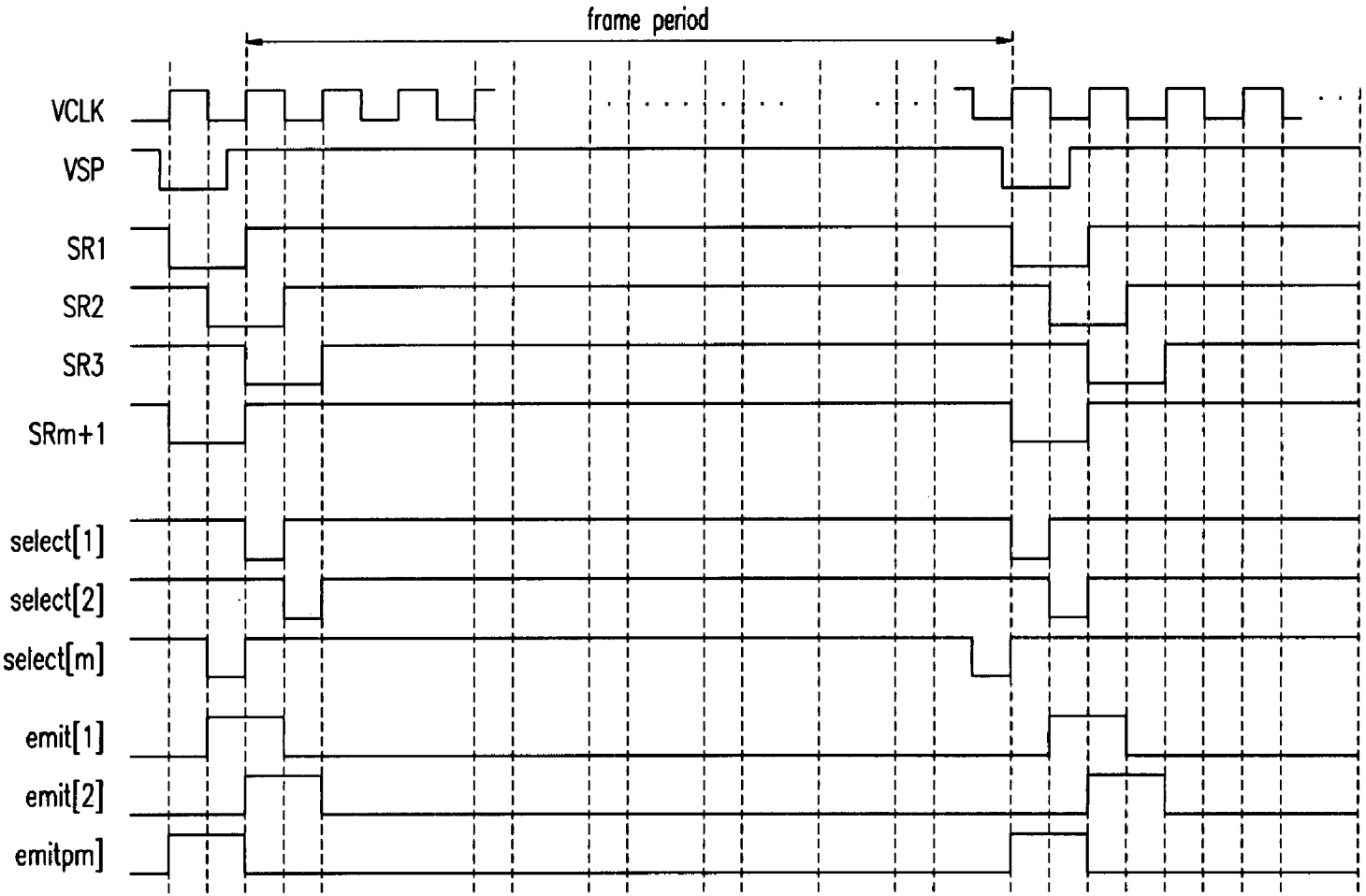

FIG. 6 shows a scan driver according to a first embodiment of the present invention, and FIG. 7 and FIG. 8 show driving waveforms of the scan driver according to the first embodiment of the present invention.

As shown in FIG. 6, the scan driver according to the first embodiment of the present invention includes a shift register 310, NAND gates $NAND_1$ to $NAND_m$, and inverters $IN_1$ to $IN_m$. For ease of description, it is assumed that m of the NAND gates $NAND_1$ to $NAND_m$ and m of the inverters $IN_1$ to $IN_m$ are provided corresponding to the number of the selection scan lines $X_1$ to $X_m$.

The shift register 310 receives a clock signal VCLK and a start signal VSP, and sequentially generates output signals $SR_1$ to $SR_{m+1}$ while shifting by a half clock signal Tp. The inverters $IN_1$ to $IN_m$ invert the output signals $SR_1$ to $SR_{m+1}$ generated from the shift register 310, and the NAND gates NAND1 to NANDm perform the NAND operation with the output signals $SR_1$ to $SR_{m+1}$ of the shift register 310 and the output signals of the inverters $IN_1$ to $IN_m$ so as to generate emission signals emit[1] to emit[m] and selection signals select[1] to select[m].

With reference to FIG. 7 and FIG. 8, an operation of the scan driver in FIG. 6 will be described in more detail.

As shown in FIG. 7, the shift register 310 receives the start signal VSP when the clock signal VCLK is high and the start signal VSP is sustained until the clock signal VLCK becomes high again. Then, the shift register 310 sequentially generates a plurality of output signals $SR_2$ to $SR_{m+1}$ while shifting the output signal $SR_1$ by the half clock signal. Herein, a high-level clock signal is generated three times while one start signal VSP is generated, and thus the width of the high-level pulse of the respective output signals $SR_2$ to $SR_{2+1}$ is the same as three times of one clock signal period Tc1.

The inverters $IN_1$ to $IN_m$ invert the output signals $SR_2$ to $SR_{m+1}$ of the shift register 310 to generate the emission signals emit[1] to emit[m]. Further, NAND gates $NAND_1$ to $NAND_m$ performs the NAND operation on the output signals $SR_1$ to $SR_m$ of the shift register 310 and the emission signals emit[1] to emit[m]. An output signal select[i] of the NAND gate NANDi becomes low when the NAND operation is performed on the output signal SRi of the shift inverter 310 and the emission signal emit[i]. Herein, both signals must be high ($1<i<m$, i is an integer). However, the emission signal emit[i] is an inverted signal of the output signal $SR_{i+1}$, and the output signal SRi+1 is shifted about a period of Tp with respect to the output signal $SR_i$, and therefore a selection signal select[i] having the width of Tp is generated by the NAND operation performed on the output signal $SR_i$ and the emission signal emit[i].

FIG. 8 shows a driving waveform when the width of the start signal VSP is set to be different compared to the foregoing embodiment, and (m/2−1) clock signals VCLK become high during one start signal VSP. In particular, (m/2) clock signals are applied to the shift register 301 during one frame period, and the start signal VSP is sustained at a low level while one clock signal VCLK is generated, and accordingly (m/2−1) clock signals VCLK become high during when one start signal VSP is generated.

In a like manner, the width of the output signals $SR_1$ to $SR_{m+1}$ of the shift register 310 can be adjusted by changing the width of the high-level pulse of the start signal VSP, and accordingly the width of the low-level pulse of the emission signals emit[1] to emit[m] can be changed in the same manner. In other words, the length of the light-on period of the pixel circuit can be adjusted by controlling the start signal VSP applied to the shift register 310 without changing the driving circuit.

As shown in FIG. 8, the interval of the output signals SR1 to SRi+1 remains the same although the width of the low-level of the emission signals emit[1] to emit[m] has been changed, and thus variation of the emission signals does not affect the selection signals select[1] to select[m].

Further, in the organic light emitting display according to the first embodiment of the present invention, the output signal $SR_{i+2}$ can be inverted to be used as the emission signal emit[o] instead of using the output signal $SR_{i+1}$. In this case, the low-level pulse of the emission signal emit[i] starts when a half clock signal is generated after the low-level pulse of the selection signal select[i] is changed to a high-level pulse.

Hereinafter, an internal structure and an operation of the shift register 310 in FIG. 6 will be described in more detail.

Figure 9:
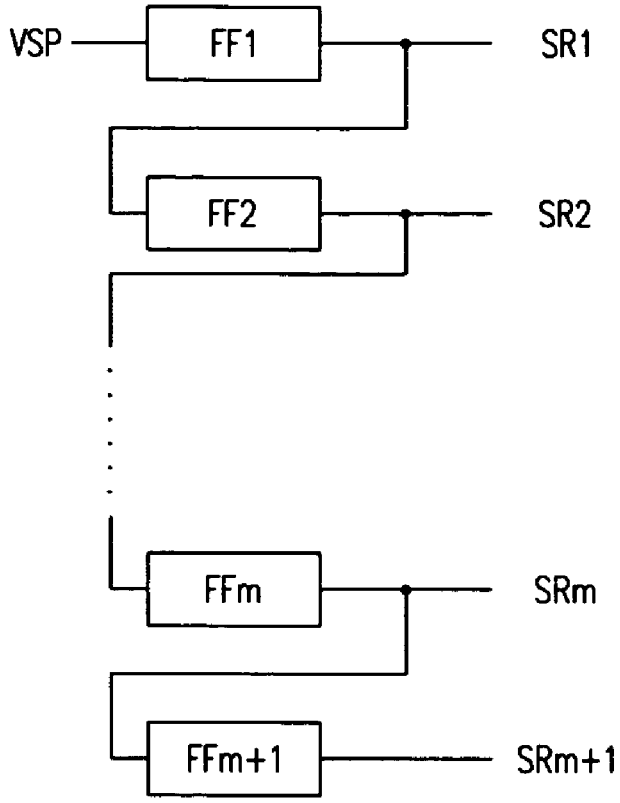
FIG. 9 is a schematic circuit diagram of a shift register included in the scan driver according to the first embodiment of the present invention.
Figure 10A:
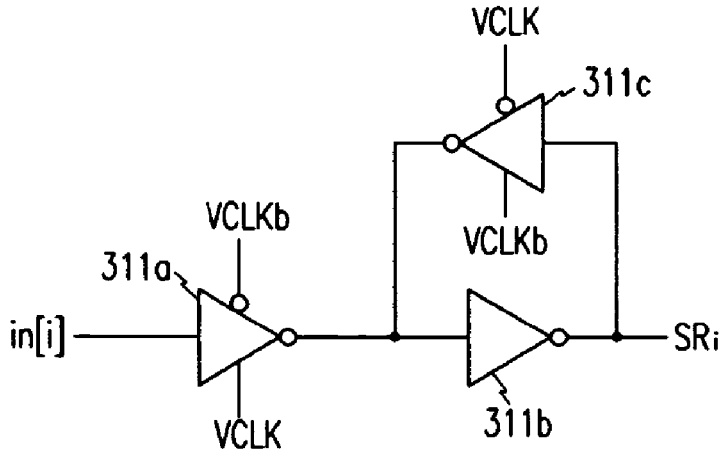
FIGS. 10A and 10B respectively illustrate an odd numbered flip-flop and an even numbered flip-flop among flip-flops in the shift register.
Figure 10B:
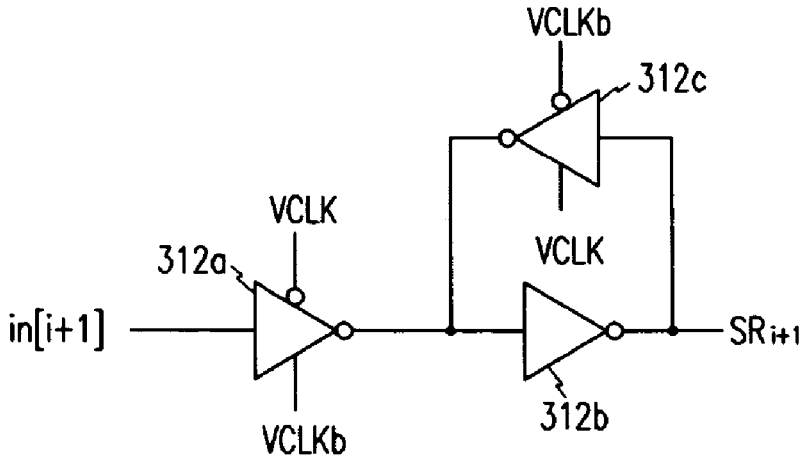
Figure 11:
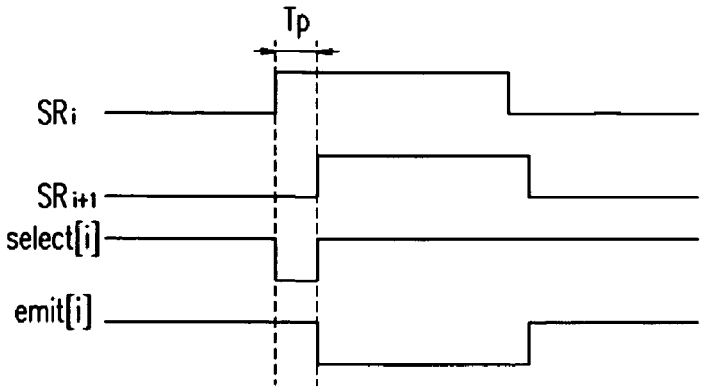
FIG. 11 shows a selection signal and an emission signal, and an output signal of the flip-flop in FIG. 10A and FIG. 10B.

FIG. 9 is a schematic circuit diagram of the shift register 310, and FIG. 10A and FIG. 10B respectively illustrate odd numbered flip-flops and even numbered flip-flops employed in the shift register 310. A clock signal VCLKb in FIG. 10A and FIG. 10B is an inverted signal of a clock signal VCLK. FIG. 11 illustrates an output signal, a selection signal, and an emission signal of these flip-flops.

As shown in FIG. 9, the shift register 310 includes (m+1) flip-flops $FF_1$ to $FF_{m+1}$, and the output signal of the respective flip-flops $FF_1$ to $FF_{m+1}$ becomes output signals $SR_1$ to $SR_{m+1}$ of the shift register 310. An input signal of the first flip-flop $FF_1$ becomes a start signal VSP, the output signal of the ith flip-flop $FF_i$ becomes an input signal of the (i+1)th flip-flop $FF_{i+1}$.

The flip-flop $FF_i$ of the shift register 310 receives a signal when the clock signal is high and the input is sustained until the next high-level clock signal. Further, the odd numbered flip-flop and the even numbered flip-flop arranged in a longitudinal direction have the same structure, but the clock signals VCLK and VCLKb are reversed. Hereinafter, the odd numbered flip-flop FFi and the even numbered flip-flop FFi+1 coupled next to the odd numbered flip-flop FFi will be described.

Referring to FIG. 10A, a three-phase inverter 311*a* provided in an input terminal of the odd numbered flip-flop FFi inverts an input signal in[i] in response to the high-level clock signal and outputs the inverted signal, and an inverter 311*b* inverts the output signal from the three-phase inverter 311*a* and outputs the invented signal. When the clock signal becomes low, the three-phase inverter 311*a* inverts the output signal from the inverter 311*b* and outputs the inverted signal, and then the inverted signal is inverted again by the inverter 311*b* and output. Therefore, the odd numbered flip-flop FFi latches the input signal input when the clock signal is high during one clock signal VCLK, and outputs the input signal as an output signal $SR_i$.

As shown in FIG. 10B, a three-phase inverter 312*a* provided in an input terminal of the even numbered flip-flop $FF_{i+1}$ inverts an input signal in[i+1] in response to the low-level clock signal VCLK and outputs the inverted signal, and an inverter 312*b* inverts the output signal of the three-phase inverter 312*a* and outputs the inverted signal. When the clock signal VCLK becomes high, a three-phase inverter 312*c* inverts the output signal from the inverter 312*b* and outputs the inverted signal, and then the inverted signal is inverted again by the inverter 312*b* and output. Therefore, the even numbered flip-flop $FF_{i+1}$ latches the input signal IN[i+1] input when the clock signal VCLK is high during one clock signal, and outputs the input signal as an output signal $SR_{i+1}$.

Briefly, the odd numbered flip-flop FFi in FIG. 10A latches the input signal in[i] of the high-level clock signal and outputs it during one clock signal VCLK, and the even numbered flip-flop FFi+1 in FIG. 10B latches the input signal IN[i+1] of the low-level clock signal and outputs it during one clock signal VCLK.

Further, the output signal SRi of the odd numbered flip-flop FFi becomes the input signal in[i+1] of the even numbered flip-flop FFi+1, and therefore the output signal SRi+1 of the even numbered flip-flop FFi+1 becomes the output signal SRi of the odd numbered flip-flop FFi, wherein the output signal SRi is delayed about a half clock signal Tp.

Herein, a selection signal select[i] generated from the NAND operation on the output signal SRi of the (n+1)th flip-flop signal and the emission signal emit[i] has a low-level pulse with the width of Tp since the emission signal emit[i] is an inverted signal of the output signal SRi+1 from the (i+1)th flip-flop FFi+1.

Figure 12:
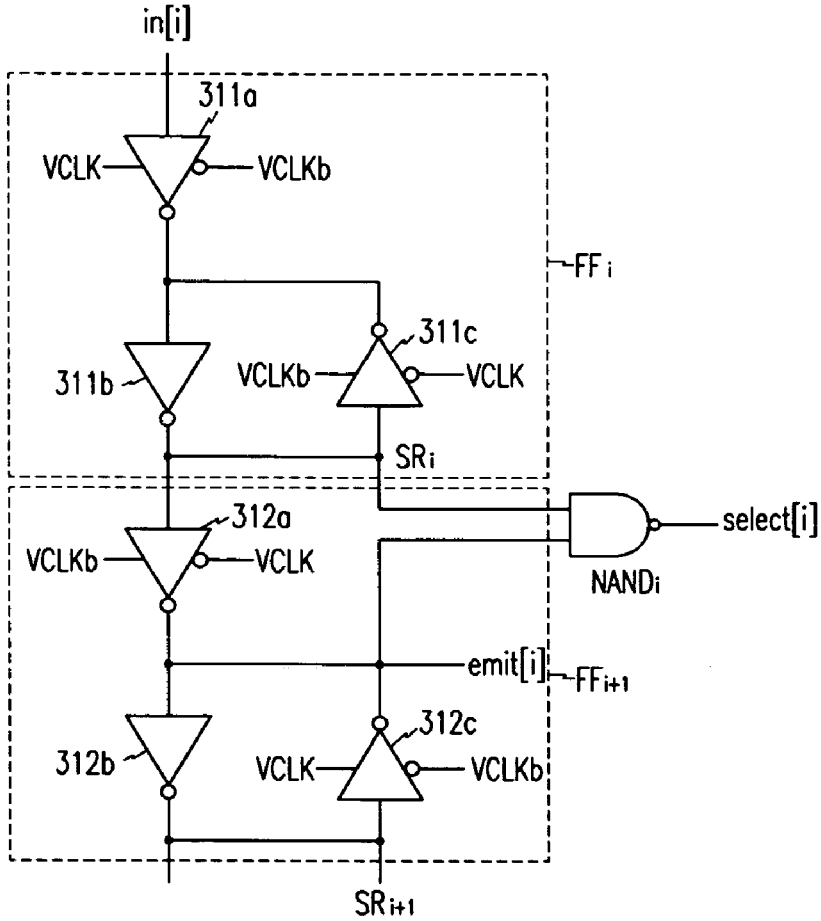
FIG. 12 shows the ith flip-flop and the (i+1)th flip-flop in a scan driver according to a second embodiment of the present invention.

Hereinafter, a scan driver according to a second embodiment of the present invention will be described with reference to FIG. 12. FIG. 12 is a circuit diagram illustrating a scan driver according to the second embodiment of the present invention, and shows the ith flip-flop FFi and the (i+1)th flip-flop for generating a selection signal select[i] and an emission signal emit[i].

The scan driver according to a second embodiment of the present invention generates the emission signal emit[i] using an internal signal of the flip-flop FFi+1, differing from the scan driver according to the first embodiment of the present invention.

As shown in FIG. 12, the selection signal select[i] is derived from the NAND operation with the output signal SRi of the flip-flop FFi and the emission signal emit[i], and the emission signal employs the output signal of the three-phase inverter 312*a* included in the flip-flop FFi+1.

In this case, the inverter INi is not a necessary element for generating the emission signal emit[i] since the internal signal of the flip-flop FFi+1 is used instead, and thereby requiring a lesser number of devices in the operation of the scan driver.

However, the selection signal select[i] and the emission signal emit[i] can be concurrently low due to delay of the NAND gate NANDi. As a result, wrong data can be programmed to the pixel circuit because currents flow to the OLED while a data signal is programmed to the pixel circuit. In other words, currents flowing to the transistor M1 in the light-on period cannot be the same as the data current in the case that the current flows to the OLED through the transistor M3 while the data signal is programmed to the pixel circuit in FIG. 4.

Therefore, the scan driver is designed in consideration of an output timing difference between the selection signal select[i] and the emission signal emit[i].

Figure 13:
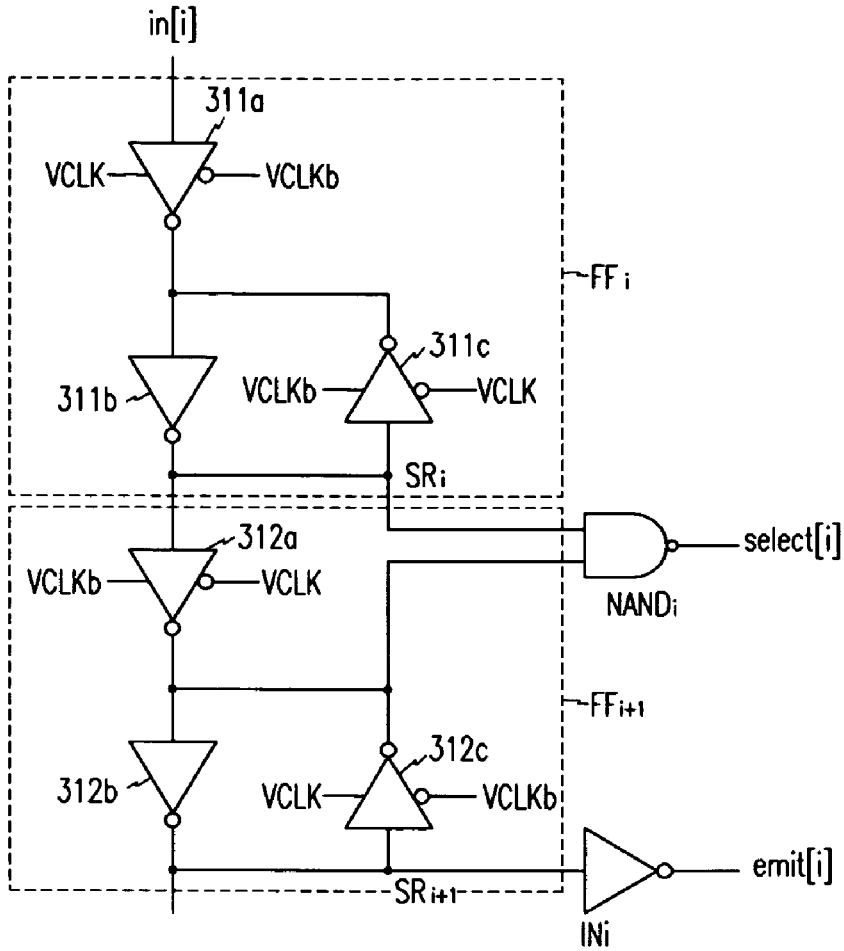
FIG. 13 shows the ith flip-flop and the (i+1)th flip-flop in a scan driver according to a third embodiment of the present invention.

As shown in FIG. 13, a scan driver according to a third embodiment of the present invention generates the selection signal select[i] by performing the NAND operation on the output signal SR1 of the ith flip-flop FFi and the internal signal of the (i+1)th flip-flop FFi+1, and inverts the output signal of the (i+1)th flip-flop FFi+1 through the inverter INi so as to output the emission signal emit[i].

Herein, assume that the inverters 312*a* and 312*b*, the NAND gate NADNi, and the inverter INi in the flip-flop FFi+1 are equally delayed. In this case, the output timing of the emission signal emit[i] is delayed as much as the inverter INi is delayed compared to the output timing of the selection signal select[i].

Therefore, the current must flow to the OLED after data is programmed to the pixel circuit for the purpose of preventing wrong data from being programmed.

Hereinafter, a scan driver according to a fourth embodiment of the present invention will be described.

Figure 14:
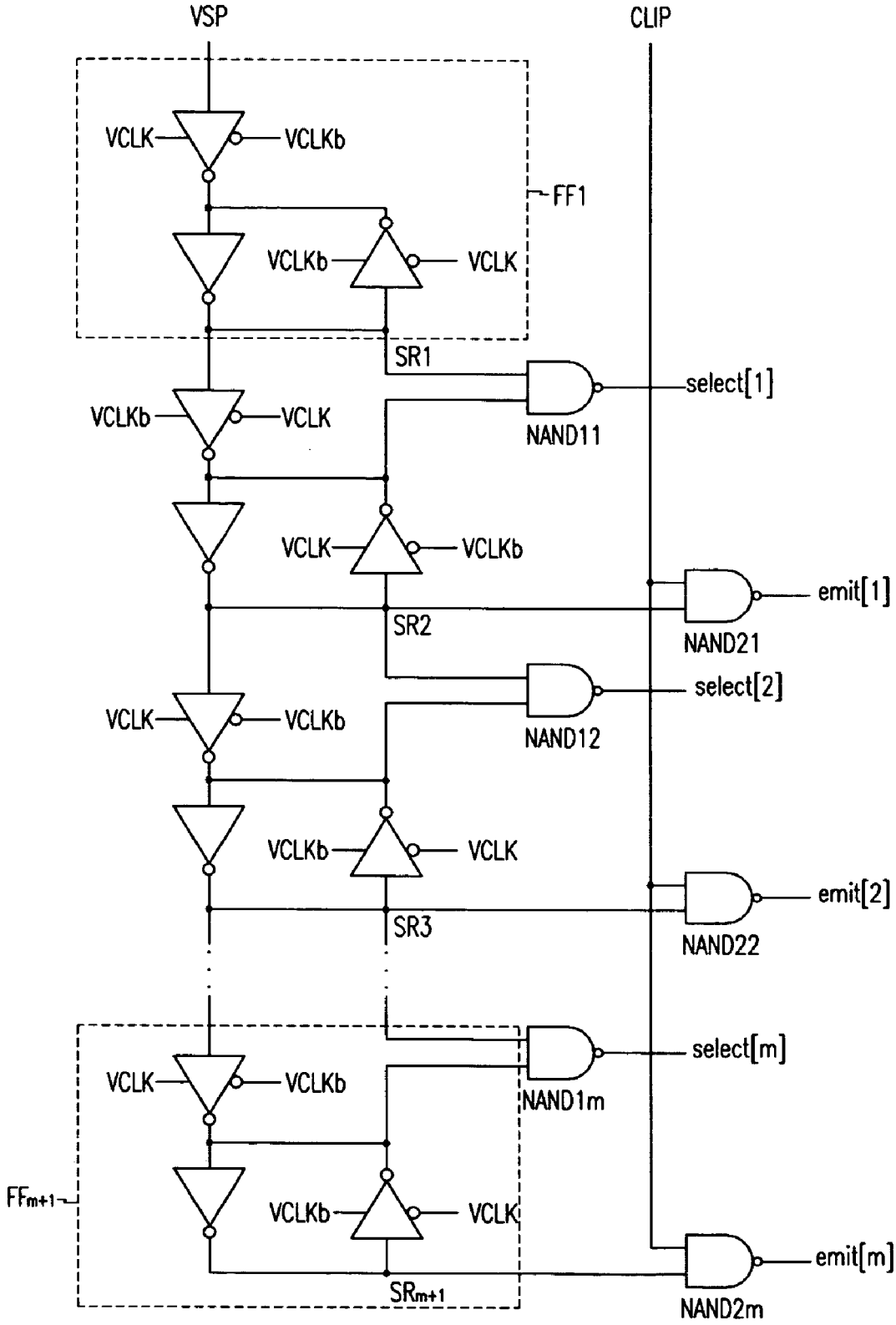
FIG. 14 is a circuit diagram of a scan driver according to a fourth embodiment of the present invention.
Figure 15:
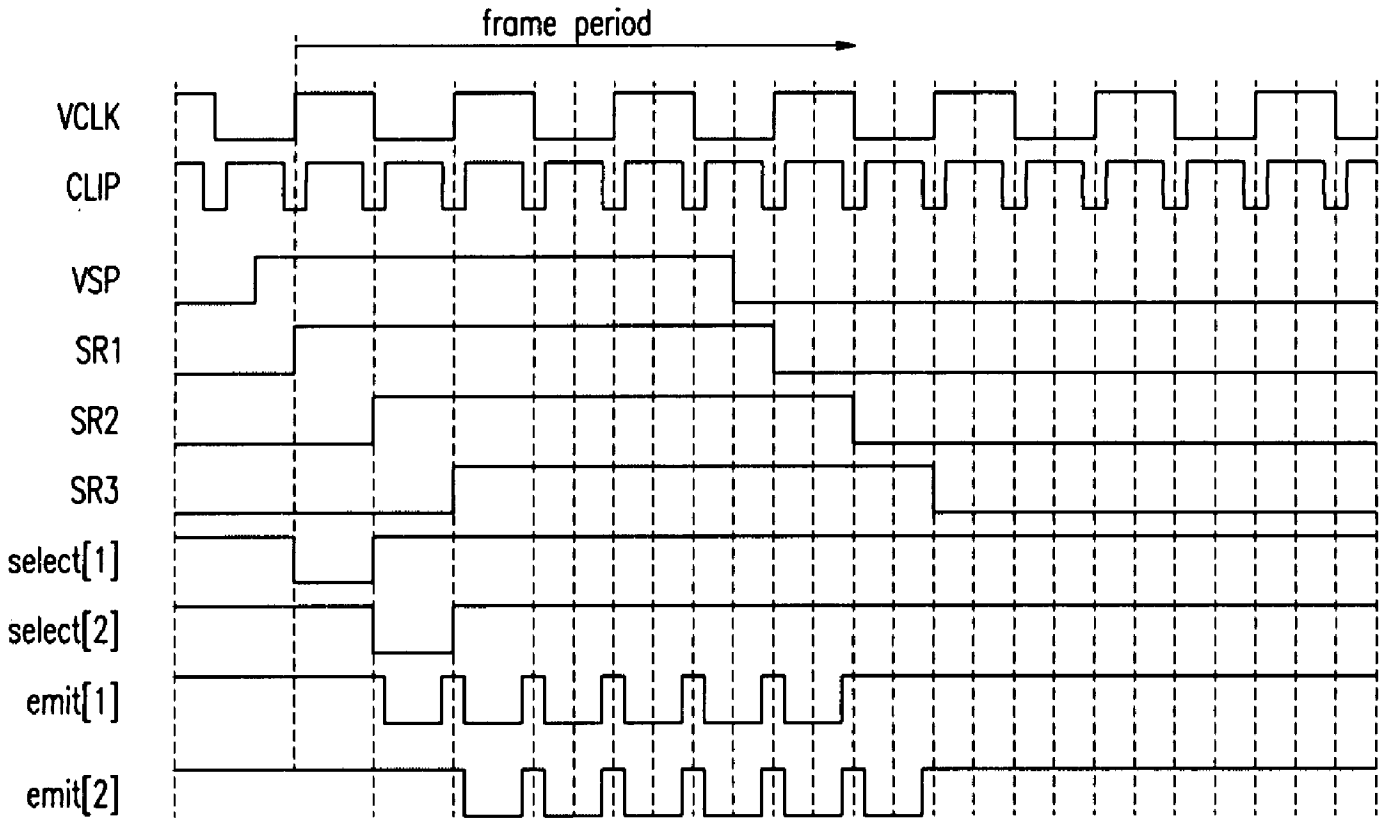
FIG. 15 is a driving waveform of the scan driver according to the fourth embodiment of the present invention.

FIG. 14 shows a circuit diagram of a scan driver according to the fourth embodiment of the present invention, and FIG. 15 shows a driving waveform of the scan driver according to the fourth embodiment of the present invention.

The scan driver according to the fourth embodiment of the present invention generates the emission signals emit[i] to emit[m] by performing the NAND operation on the output signals SR2 to SRm+1 and a clip signal CLIP of the flip-flops FF2 to FFm+1, differing from the scan driver according to the third embodiment of the present invention.

The output signal of the NAND gate NANDi becomes low when one of two input signals is low according to the NAND operation, and thus the emission signal emit[i] becomes high when the clip signal CLIP is low.

Accordingly, in the case that the emission signal is generated by using the clip signal CLIP and the NAND gates NAND1 to NANDm as described in the fourth embodiment of the present invention, a front portion of the low-level pulse of the emission signal emit[i] is cut for the purpose of preventing the low-level selection signal select[i] and the low-level emission signal emit[i] from being overlapped.

Hereinafter, a scan driver according to a fifth embodiment of the present invention will be described with reference to FIG. 16 and FIG. 17.

Figure 16:
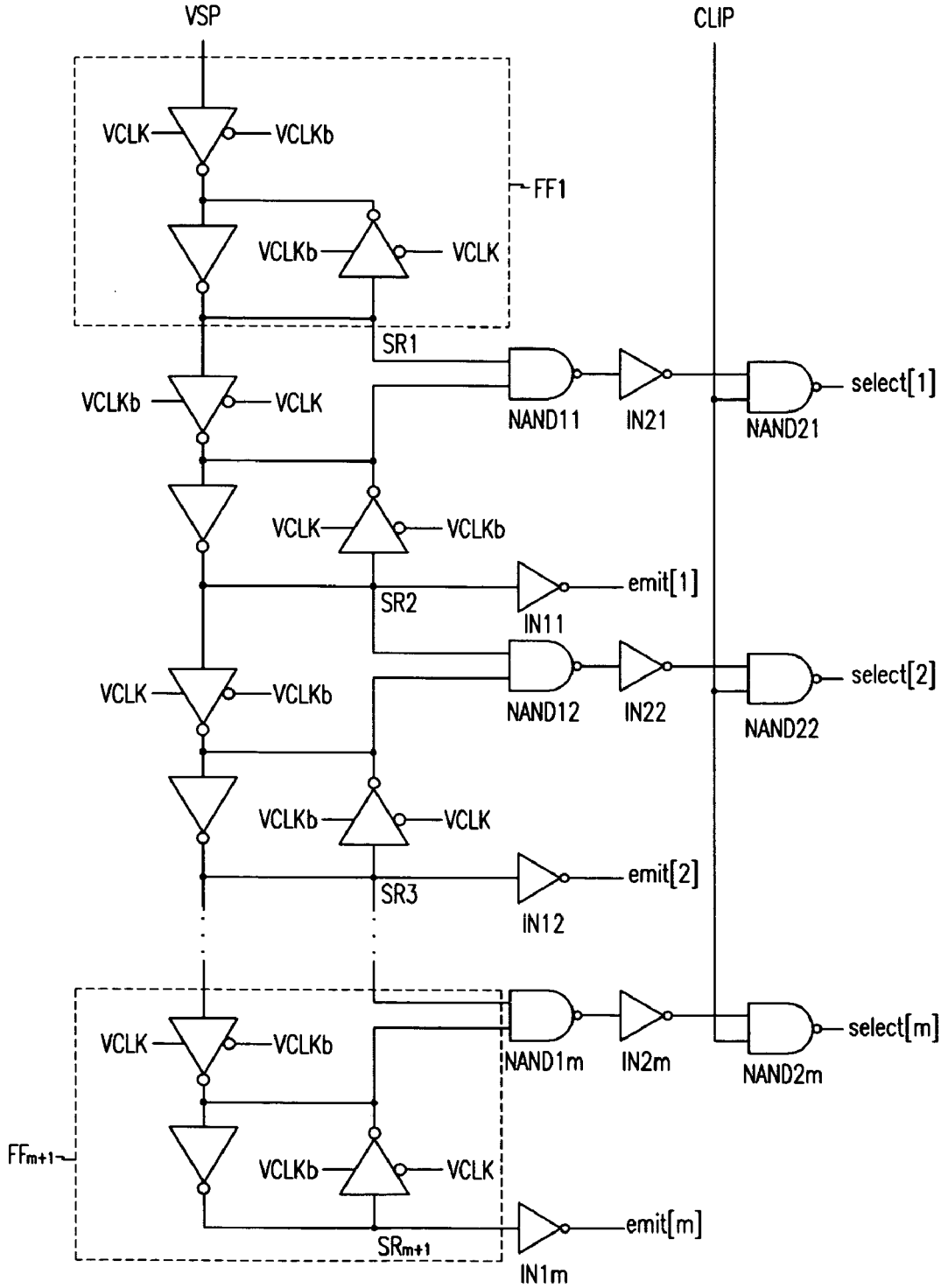
FIG. 16 is a circuit diagram of a scan driver according to a fifth embodiment of the present invention.
Figure 17:
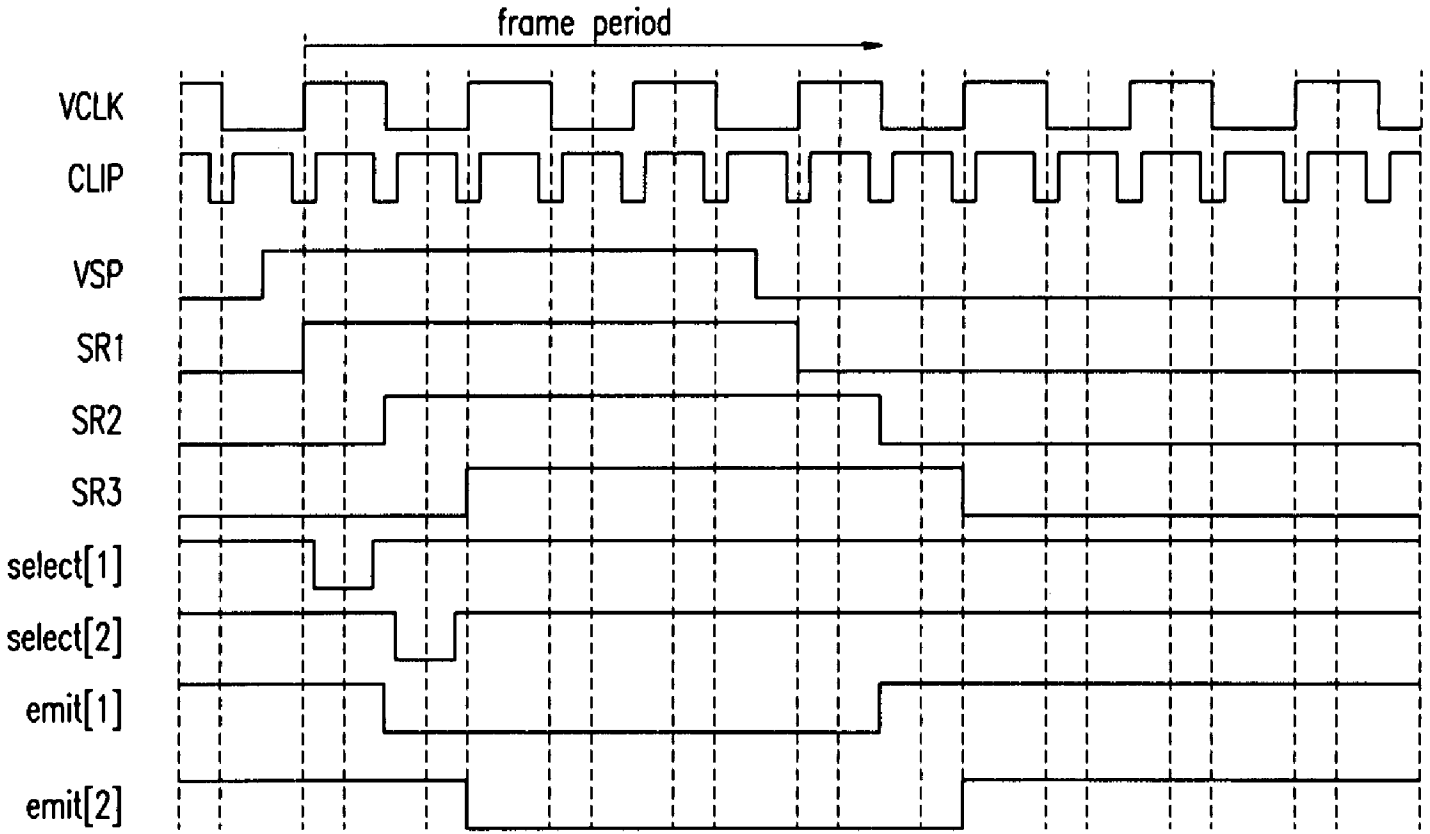
FIG. 17 is a driving waveform of the scan driver according to the fifth embodiment of the present invention.

FIG. 16 shows an internal circuit of the scan driver according to the fifth embodiment of the present invention, and FIG. 17 shows a driving waveform of the scan driver according to the fifth embodiment of the present invention.

The scan driver according to the fifth embodiment of the present invention inverts the output signal SRi+1 of the (n+1) th flip-flop FFi+1 so as to output the emission signal emit[i] as described in the third embodiment of the present invention, and the selection signal select[i] performs the NAND operation on a signal and the clip signal CLIP, differing from the scan driver described in the third embodiment of the present invention wherein the signal is an inverted signal of a signal derived from the NAND operation on the output signal SRi of the ith flip-flop FFi and the internal signal of the (i+1)th flip-flop FFi+1.

An operation of the scan driver according to the fifth embodiment of the present invention will be described in detail, hereinafter.

As shown in FIG. 17, the inverters IN11 to IN1*m* invert the output signals SR2 to SRm+1 of the shift register 310 so as to output the emission signals emit[1] to emit[m]. Further, the NAND gate NANDi generates a signal by performing the NAND operation on the output signal SR1 of the flip-flop FFi and the internal signal of the flip-flop FFi. Herein, the output signal of the NAND gate NANDi has the same waveform of the selection signal select[i] according to the first embodiment of the present invention. The inverter IN2*i* inverts the output signal of the NAND gate NAND1*i*, and the NAND gate NAND2*i* performs the NAND operation between the output signal of the inverter IN2*i* and the clip signal CLIP so as to generate the selection signal select[i].

The selection signal select[i] according to the fifth embodiment of the present invention is sustained at the high level in a like manner that the selection signal according to the first embodiment of the present invention is sustained at the high level during the clip signal CLIP is in the low-level.

Therefore, the selecting signal select[i] and the emission signal emit[i] cannot be overlapped by cutting lateral ends of the low-level pulse of the selection signal select[i] by using the clip-signal CLIP.

Figure 18:
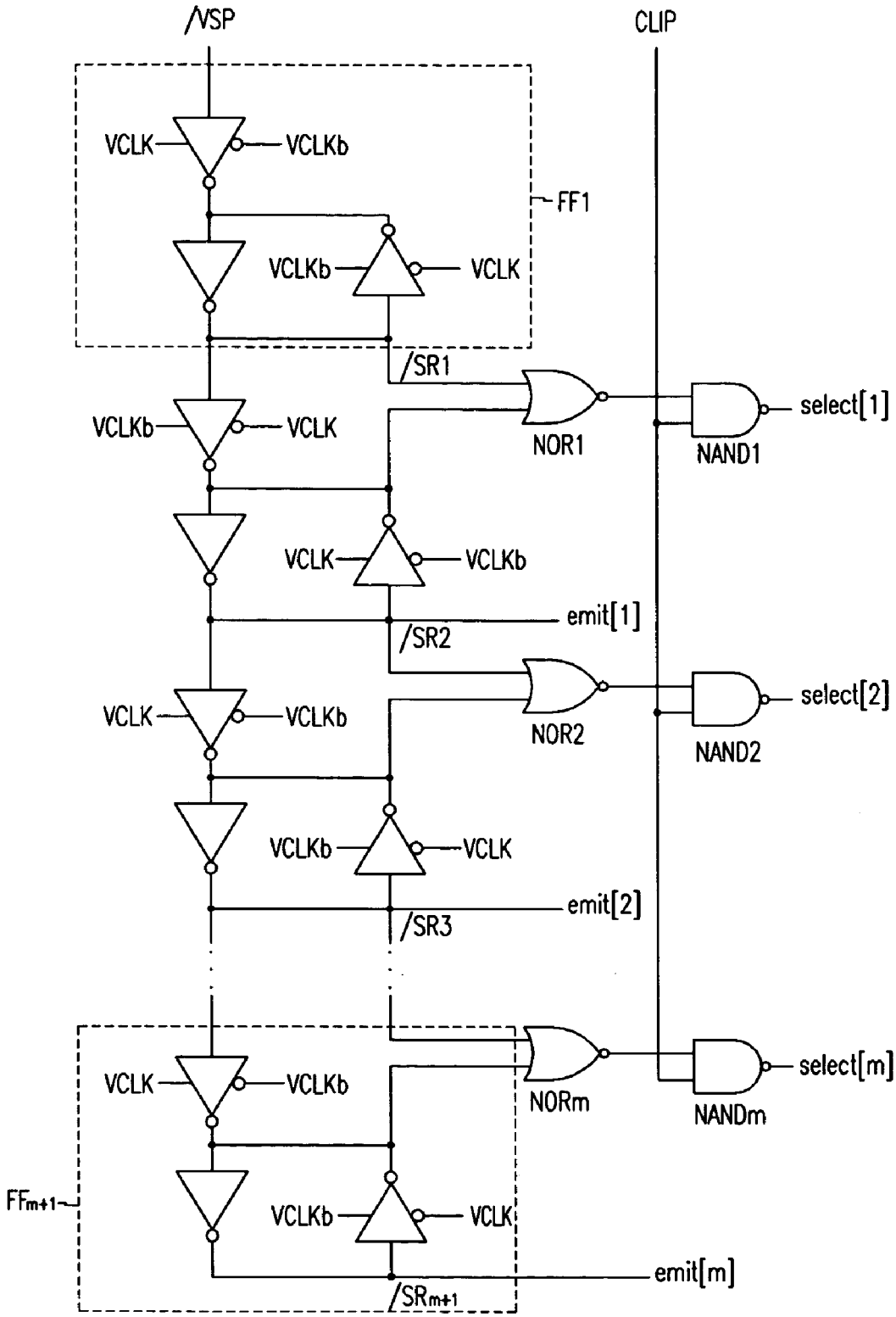
FIG. 18 is a circuit diagram of a scan driver according to a sixth embodiment of the present invention.
Figure 19:
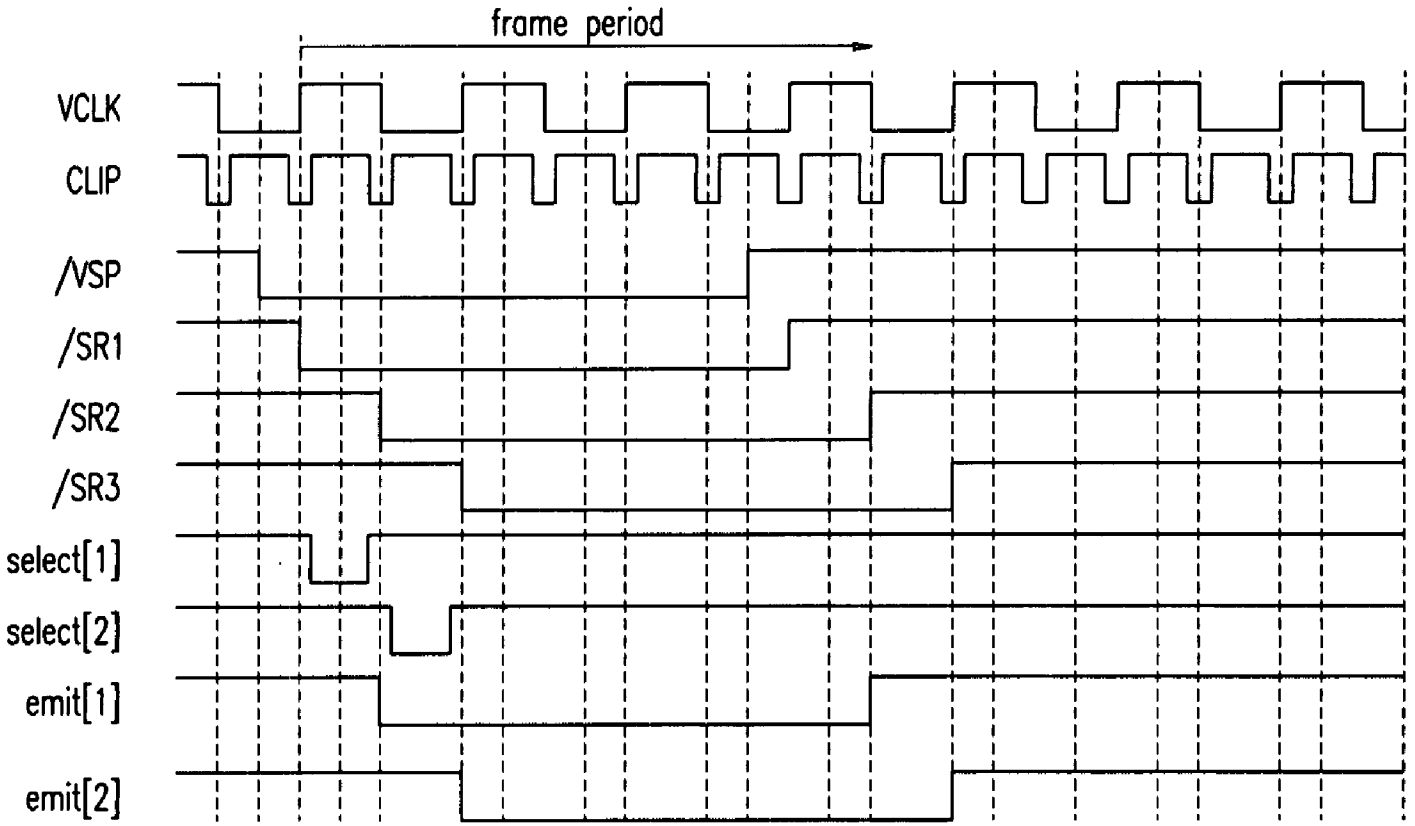
FIG. 19 is a driving waveform of the scan driver according to the sixth embodiment of the present invention.

FIG. 18 shows a scan driver according to a sixth embodiment of the present invention, and FIG. 19 shows a driving waveform of the scan driver according to the sixth embodiment of the present invention.

The scan driver according to the sixth embodiment of the present includes (m+1) flip-flops FF1 to FFm+1, m NOR gates NOR1 to NORm, and m NAND gates NAND1 to NANDm.

The flip-flop FF1 inputs a start signal/VSP and the clock signal VCLK, and maintains the start signal/VSP during one clock signal period so as to generate an output signal/SR1 when the clock signal VCLK is high. Further, the flip-flop FF2–FFm+1 sequentially outputs the output signal/SR1 of the flip-flop FF1 while shifting by a half clock signal. Herein, the start signal/VSP is an inverted signal of the start signal VSP in the first embodiment of the present invention, and therefore an output signal of the shift register 310 of the scan driver according to the sixth embodiment of the present invention is an inverted signal of the output signal SR1-SRm+1 in the first embodiment of the present invention.

Further, one NOR gate NORi inputs the output signal/SRi of the ith flip-flop FFi and the internal signal of the (i+1)th flip-flop FF(i+1) to perform the NOR operation. Herein, the NOR gate NORi outputs a high-level signal only when these input signals are low signals.

The NAND gate NANDi performs the NAND operation on the output signal of the NOR gate NORi and the clip signal CLIP so as to output a select signal select[i].

Accordingly, the select signal select[i] is maintained at the high level while the clip signal CLIP is low, as shown in FIG. 19.

Thus, when the output timings of the select signal select[i] and the emission signal emit[i] are not substantially synchronized, the lateral ends of the low-level pulse of the select signal select[i] are cut by using the clip signal CLIP so as to prevent the select signal select[i] and the emission signal emit[i] from being overlapped in the low-level.

As described in the first embodiment through the sixth embodiment of the present invention, the scan driver is provided to control the emit signal applied to the pixel circuit and the duty ratio of light emitted from the OLED.

In addition, the clip signal cuts the lateral ends of the low-level pulse of the selection signal or the emission signal when the output timing of these signals are not synchronized so as to prevent the selection signal and the emission signal from being low at the same time, and thereby to prevent wrong data from being programmed due to the current flowing to the OLED while data is being programmed to the pixel circuit.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

For instance, the selection signal and the emission signal are transmitted to the pixel circuit per frame by one scan driver according to the foregoing embodiments of the present invention, but one frame can be divided into more than two fields and each pixel circuit of the respective fields can be driven by different scan drivers.

Further, the present invention efficiently reduces time consumed for charging the data lines. In particular, the time for charging the data line can be reduced without increasing brightness of tall pixels although the current $I_{OLED}$ flowing to the OLED is boosted.

In addition, the light emit device according to the present invention can be stably driven by using a high current area having small deviation in currents of a driving transistor.

What is claimed is:

1. An organic light emitting display comprising:

a plurality of pixel circuits in a matrix;

a plurality of first scan lines for transmitting selection signals;

a plurality of second scan lines for transmitting emission signals to control a duration of light emission of the pixel circuits; and a scan driver for sequentially delaying a primary signal having a pulse at a first voltage level by a first period to generate a plurality of secondary signals, for inverting the plurality of secondary signals and outputting them as the emission signals, and for generating the selection signals having a pulse at a second voltage level when the secondary signals and the emission signals are at the first voltage level.

2. The organic light emitting display according to claim 1, wherein the scan driver comprises a shift register for sequentially delaying the primary signal by the first period to generate the plurality of secondary signals.

3. The organic light emitting display device according to claim 2, wherein the secondary signals comprise a first secondary signal and a second secondary signal, and wherein the scan driver is configured to invert the second secondary signal and to output the inverted second secondary signal as an emission signal of the emission signals, and to generate the first selection signal of the selection signals having a pulse at the second voltage level when the first secondary signal and the emission signal of the emission signals are both at the first voltage level.

4. The organic light emitting display device according to claim 2, wherein the shift register comprises a plurality of flip-flops for generating the secondary signals by delaying each of the flip-flops respective input signal by the first period.

5. The organic light emitting display according to claim 4, wherein each of the flip-flops comprises:

a first inverter synchronized to a first clock signal for inverting the input signal to output the inverted input signal;

a second inverter for inverting an output signal of the first inverter to generate a secondary signal of the plurality of secondary signals; and a third inverter coupled to the second inverter for synchronizing the secondary signal to a second clock signal, and for inverting the secondary signal to output the inverted secondary signal.

6. The organic light emitting display according to claim 5, wherein the first clock signal and the second clock signal are inverted with respect to each other.

7. The organic light emitting display according to claim 6, wherein among the plurality of flip-flops, the first clock signal applied to odd numbered flip-flops and the first clock signal applied to even numbered flip-flops are inverted with respect to each other.

8. The organic light emitting display according to claim 5, wherein the plurality of flip-flops comprise a first flip-flop and a second flip-flop adjacent to the first flip-flop, and the scan driver is configured to output an input signal of the second inverter of the second flip-flop as an emission signal of the emission signals.

9. The organic light emitting display according to claim 8, wherein the scan driver is configured to output a selection signal of the selection signals, the selection signal having a pulse at the second voltage level when an output signal of the first flip-flop and the emission signal of the emission signals are at the first level.

10. The organic light emitting display according to claim 4, wherein the first period is substantially the same as a half period of the first clock signal.

11. An organic light emitting display comprising:

a plurality of pixel circuits in a matrix;

a plurality of first scan lines for transmitting selection signals to select the pixel circuits;

a plurality of second scan lines for transmitting emission signals to control a duration of light emission of the pixel circuits;

a first driver for sequentially delaying a primary signal having a pulse at a first level by a first period in response to a clock signal to generate secondary signals;

a second driver for receiving the secondary signals and third signals, the third signals being inverted signals of the secondary signals, and for outputting the selection signals having a pulse at a second level when the secondary signals and the third signals are at the first level; and a third driver for receiving the plurality of secondary signals and fourth signals, and for outputting the emission signals, the emission signals having a pulse at the second level when the secondary signals and the fourth signals are at the first level.

12. The organic light emitting display according to claim 11, wherein the fourth signals have a pulse at the second level when the level of the clock signal is changed.

13. The organic light emitting display according to claim 11, wherein the first period is substantially the same as a half period of the clock signal.

14. An organic light emitting display comprising:

a plurality of pixel circuits in a matrix;

a plurality of first scan lines for transmitting selection signals to select the pixel circuits;

a plurality of second scan lines for transmitting emission signals to control a duration of light emission of the pixel circuits;

a first driver for sequentially delaying a primary signal having a pulse at a first level for a first period in response to a first clock signal to generate a plurality of output signals;

a second driver for generating third signals having a pulse at a second level when second signals are at the first level, the second signals corresponding to a logical operation of adjacent first and second output signals among the plurality of output signals, and for outputting inverted signals of the second output signals as the emission signals; and a third driver for receiving the third signal, and for changing lateral ends of the pulse at the second level of the third signal into the first level during a predetermined period so as to output a fourth signal as the selection signal.

15. The organic light emitting display according to claim 14, wherein the first period is substantially the same as a half period of the first clock signal.

16. The organic light emitting display according to claim 14, wherein the first driver comprises a plurality of flip-flops having a first inverter synchronized to a second clock signal for inverting an input signal, a second inverter for inverting an output of the first inverter to output an output signal of the plurality of output signals, and a third inverter coupled to the second inverter for synchronizing the output signal to a third clock signal to invert the output signal.

17. The organic light emitting display according to claim 16, wherein the second clock signal is applied to odd numbered flip-flops among the plurality of flip-flops and is substantially the same as the first clock signal, and the third clock signal is an inverted signal of the first clock signal.

18. The organic light emitting display according to claim 17, wherein the second clock signal applied to even numbered flip-flops among the plurality of flip-flops is an inverted signal of the first clock signal, and the third clock signal is substantially the same as the first clock signal.

19. The organic light emitting display according to claim 18, wherein an output of the third inverter is an input of the second inverter.

20. The organic light emitting display according to claim 14, wherein the third driver is further configured to receive a fifth signal alternately having the first level and the second level, and to output the selection signal as a pulse having the second level when the third signal is at the second level and the fifth signal is at the first level.

21. The organic light emitting display according to claim 20, wherein the fifth signal has a pulse at the second level when the level of the first signal is changed.

22. A method of driving an organic light emitting display having a plurality of first scan lines for transmitting a plurality of selection signals and a plurality of second scan lines for transmitting a plurality of emission signals, the method comprising:

sequentially delaying a primary signal having a first level pulse by a first period to generate a plurality of secondary signals;

inverting the secondary signals to output as the emission signals; and outputting a selection signal of the plurality of selection signals having a second level pulse when a secondary signal of the plurality of secondary signals and an emission signal of the plurality of emission signals are at the first level.

23. The method according to claim 22, wherein a width of the selection signal is substantially the same as the first period.

24. A method of driving a light emission display having a plurality of first scan lines for transmitting a selection signal and a plurality of second scan lines for transmitting an emission signal, the method comprising:

synchronizing a primary signal having a first-level signal to a clock signal and sequentially delaying the synchronized signal by a first period to generate a plurality of secondary signals;

inverting the secondary signals to generate a third signal having a second-level pulse;

changing the lateral ends of the second level pulse of the third signal into the first level during a predetermined period so as to output the emission signal; and outputting the selection signal having the second-level pulse when the secondary signal and the emission signal are at the first level.

25. The method according to claim 24, wherein the first period is substantially the same as a half period of the clock signal.

26. A method of driving an organic light emitting display having a plurality of first scan lines for transmitting a selection signal and a plurality of second scan lines for transmitting an emission signal, the method comprising:

sequentially delaying a primary signal having a first level pulse by a first period to generate a plurality of secondary signals;

inverting the secondary signals to generate the emission signal;

outputting a third signal having a second-level pulse when the primary signal and the emission signal are at the first-level; and changing the lateral ends of the second level pulse of the third signal into the first level during a predetermined period so as to output the selection signal.

* * * * *

UNITED STATES PATENT AND TRADEMARK OFFICE

CERTIFICATE OF CORRECTION

PATENT NO. : 7,746,298 B2
APPLICATION NO. : 11/113444
DATED : June 29, 2010
INVENTOR(S) : Dong-Yong Shin et al.

It is certified that error appears in the above-identified patent and that said Letters Patent is hereby corrected as shown below:

| | |
|---|---|
| Column 13, Claim 4, line 58 | Delete "flip-flops"<br>Insert -- flip-flops' -- |

Signed and Sealed this
Eleventh Day of October, 2011

David J. Kappos

David J. Kappos
*Director of the United States Patent and Trademark Office*